US006854394B2

(12) United States Patent
Henry et al.

(10) Patent No.: US 6,854,394 B2
(45) Date of Patent: Feb. 15, 2005

(54) FIN-STABILIZED AMMUNITION

(75) Inventors: Guy H. Henry, Mount Vernon, IL (US); Donald E. Dillard, Murphysboro, IL (US); Rao Yalamanchili, Flanders, NJ (US); Dennis J. Conway, East Stroudsburg, PA (US); Rick D. Wright, Herrin, IL (US); Gary C. Fleming, Budd Lake, NJ (US); Alan N. Cohen, Wharton, NJ (US); Roger E. Joinson, Boonton, NJ (US); Gene Venable, Sparta, NJ (US); Thomas Doris, Sparta, NJ (US); Albert S. Tatka, Jr., Wantage, NJ (US)

(73) Assignee: General Dynamics Ordnance and Tactical Systems, Inc., St. Petersburg, FL (US)

( * ) Notice: Subject to any disclaimer, the term of this patent is extended or adjusted under 35 U.S.C. 154(b) by 8 days.

(21) Appl. No.: 10/641,727

(22) Filed: Aug. 15, 2003

(65) Prior Publication Data

US 2004/0216635 A1 Nov. 4, 2004

Related U.S. Application Data

(62) Division of application No. 09/804,001, filed on Mar. 12, 2001, now Pat. No. 6,655,293.

(60) Provisional application No. 60/214,901, filed on Jun. 29, 2000.

(51) Int. Cl.[7] ..... F42B 10/06; F42B 14/06

(52) U.S. Cl. ..... 102/521; 102/439; 244/3.23; 244/3.24

(58) Field of Search ..... 244/3.23, 3.24, 244/3.25, 3.26, 3.27, 3.28, 3.29, 3.3; 102/521, 522, 523, 520, 439, 513

(56) References Cited

U.S. PATENT DOCUMENTS

| | | | | |
|---|---|---|---|---|
| 3,851,590 A | | 12/1974 | LaCosta | 102/501 |
| 3,902,424 A | | 9/1975 | Dietsch et al. | 102/87 |
| 4,520,972 A | | 6/1985 | Diesinger et al. | 244/3.24 |
| 4,653,405 A | | 3/1987 | Paine | 102/3.29 |
| 4,815,682 A | | 3/1989 | Feldmann et al. | 244/3.23 |
| 4,901,646 A | | 2/1990 | Feldmann et al. | 102/521 |
| 4,978,088 A | * | 12/1990 | Himmert et al. | 244/3.24 |
| H932 H | * | 7/1991 | Ng | 244/3.23 |
| 5,297,492 A | | 3/1994 | Buc | 102/521 |
| 5,413,049 A | | 5/1995 | Feldmann et al. | 102/521 |
| 5,472,536 A | | 12/1995 | Doris et al. | 149/41 |
| 5,811,724 A | | 9/1998 | Henry, III et al. | 149/18 |

FOREIGN PATENT DOCUMENTS

DE 3927918 2/1991

OTHER PUBLICATIONS

"25–mm M242 Bushmaster", *US Naval Institute Military Database*, http://www.usni.com/demo/weapons/artguns/cmbtveh/w0003600.html, downloaded Mar. 7, 2000.

* cited by examiner

*Primary Examiner*—Michael J. Carone
*Assistant Examiner*—James S. Bergin
(74) *Attorney, Agent, or Firm*—Hunton & Williams LLP

(57) ABSTRACT

Tracer visibility of APFSDS projectiles can be enhanced through a combination of increased steady state spin rate, reduced muzzle obscuration, and optimized airflow over the stabilizing fin geometry of the sub-projectile. The preferred means to increase steady state spin rates of the sub-projectile is to incline or deflect the fin blade tip portion, creating a larger, hotter burning, tracer plume.

6 Claims, 5 Drawing Sheets

FIN-STABILIZED AMMUNITION

CROSS-REFERENCE TO RELATED APPLICATION

This patent application is a division of U.S. patent application Ser. No. 09/804,001 which was filed on Mar. 12, 2001 now U.S. Pat. No. 6,655,293 which claimed priority of U.S. Provisional Patent Application Ser. No. 60/214,901 entitled "FIN-STABILIZED AMMUNITION" that was filed on Jun. 29, 2000. The entire disclosure of the priority documents is herein incorporated by reference.

U.S. GOVERNMENT RIGHTS

The U.S. Government has certain rights to this invention, pursuant to contract number DAAE30-97-C-1088 awarded by the Department of the Army.

BACKGROUND OF THE INVENTION (1) Field of the Invention

This invention relates to fin-stabilized ammunition, and more particularly to armor-piercing fin-stabilized discarding sabot with tracer (APFSDS-T) ammunition.

(2) Description of the Related Art

There exists a well-developed art in the field of APFSDS (including, inter alia, APFSDS-T (with tracer)) ammunition. APFSDS rounds have been developed for both rifled and smoothbore barrels (tubes). A rifled barrel or tube functions to spin-stabilize a projectile encased in the sabot, a principle utilized in weapons from handguns to large naval guns. A projectile exiting the muzzle of a rifled tube typically has a relatively high spin rate. This rifling-induced spin rate is nominally equal to the product of the muzzle velocity (longitudinal) and the rifling pitch (measured in turns or revolutions per linear dimension) at the muzzle. An exemplary 105 mm rifled tube has a 1–18 twist, meaning the longitudinal distance the rifling travels downbore to make one complete revolution is eighteen times the caliber of the barrel. Thus, the exemplary pitch is one turn per 1.89 meters. With an exemplary muzzle velocity of from about 1,375 to about 1,650 meters per second, the associated spin rate will be from about 730 to about 870 revolutions per second (rps). Such a spin rate would adversely affect the performance of an APFSDS round as, once the projectile (also occasionally designated "sub-projectile") is free of the sabot, it relies on its aerodynamic fins for stability at a relatively low spin rate. The rapid angular deceleration from the rifling-induced spin rate to the preferred low spin rate may: (a) damage the sub-projectile; (b) require a weight penalty associated with providing particularly robust fins to avoid damage; and/or (c) induce wobble or other forms of instability.

Common APFSDS rounds for rifled tubes decouple rotation of the projectile from rotation induced by the rifling by providing the sabot with a "slip obturator" mounted on the sabot body in such a way as to allow the obturator to rotate about the longitudinal axis of the sabot. The obturator engages the tube bore, accommodating to the rifling and forming a seal to retain propellant gases behind the obturator. Because of its accommodation to the rifling, the obturator acquires the rifling-induced spin rate described above. With a slip obturator, this spin rate, however, is not entirely translated to the combination of the sabot body and sub-projectile. The sabot/projectile combination typically has sufficient moment of inertia about the longitudinal axis to overcome the static frictional force along the annular engagement between the obturator and sabot body to allow rotation of the obturator relative to the sabot body. Thus, the sabot body and projectile spin at a rate less than the obturator. A properly designed slip obturator results in a projectile spin rate which is a small percentage of the rifling-induced spin rate. Once the projectile is free of the sabot, it relies on its aerodynamic fins for stability as a means to maintain relatively low spin rate (e.g., about 70 revolutions per second (rps)). This is accomplished by the torque applied to the sub-projectile created by the aerodynamic force of airflow over its fin blades. Typically fin blades are chamfered, canted, or deflected in such a manner that the airflow over the projectile creates a rotational force on any forward-facing projected areas of the fin blades. Commonly APFSDS rounds are spun at low rates to normalize any physical imbalances and/or aerodynamic forces that they would be subjected to while in flight to the target.

In the subfield of medium caliber ammunition (e.g., nominal caliber 20 mm to 60 mm), APFSDS-T ammunition has also been developed. A key example is the 25 mm M919 round used by the 25 mm M242 Bushmaster automatic gun of the U.S. Army M2/M3 Bradley Fighting Vehicle (BFV). When fired from the 2.003 m long barrel of the M242, the M919 projectile has an exemplary muzzle velocity of about 1385 m/s at ambient conditions and, more broadly between about 1345 m/s and about 1400 m/s at the round's required temperature extremes. The projectile has an effective range in excess of 1500 m. With a gain twist barrel of a groove-to-groove diameter of 26.0 mm, a land-to-land diameter of 25.0–25.1 mm and a 7.5 degree twist at the muzzle, a full spin projectile would leave the muzzle with a theoretical spin rate of about 2320 rps at the exemplary 1385 m/s muzzle velocity. The effect of a slip obturator is to substantially reduce the muzzle spin rate of the projectile (e.g., to about 15–50 percent, or more particularly about 25 percent of the theoretical value).

After exiting the barrel and discarding the sabot, the projectile spin rate decays further, initially quite sharply and then more gradually, eventually approximating a steady state condition (see, U.S. Pat. No. 4,815,682 of Feldmann et al.). For consistency herein, where a numerical value is given, the steady state spin rate (SSSR) is defined as the spin rate of the projectile one second after exiting the muzzle when fired at a minimal angle of elevation under standard conditions.

Tracer visibility is critical to a weapon operator as it should allow the operator to follow the projectile flight path to permit the operator to re-aim the weapon to hit a desired target. In such small size, high velocity, long range rounds as the M919, tracer visibility has been a significant problem (see, U.S. Pat. No. 5,472,536 of Doris et al. which discloses improved visibility tracer compositions). An operator, utilizing the sighting systems of the weapon firing such a round may have a hard time acquiring the tracer in the sights and maintaining sight of the tracer.

BRIEF SUMMARY OF THE INVENTION

Accordingly, in one aspect, the invention is directed to an ammunition cartridge including a case, a saboted projectile, and a propellant charge in the case interior. The projectile includes a body having a nose and tail, a tracer mounted within the body, and a plurality of stabilizing fin blades projecting from the body. The sabot secures the projectile body to the case proximate the case mouth. The blades each have first surface portions inclined relative to a longitudinal direction by an angle of between about 3.5 and about 6.0 degrees.

In various implementations of the invention, the propellant charge may be effective to propel the projectile at a muzzle velocity of between 1300 and 1500 m/s. The angle may be effective to provide the projectile with a steady state spin rate of at least 340 rps at such muzzle velocity. The blades may be formed as flat plates and may be triangular in planform. The sabot may be dimensioned to fire the projectile from a barrel having a nominal caliber between 20 and 120 mm, more narrowly between 20 and 50 mm, and most particularly 25 mm.

In another aspect the invention is directed to a fin-stabilized discarding sabot projectile wherein at least two of the fin blades are formed having a root portion extending longitudinally. A second portion, outboard of the root portion, has a first subportion extending longitudinally and a second subportion aft of the first subportion and inclined relative thereto by an angle of between about 3.5 and about 6.0 degrees.

In various implementations of the invention, the projectile may have a tracer. There may be exactly four such blades. The angle may be between 4.3 and 5.2 degrees. The second subportion may extend to a tip of the associated blade. The second subportion may have a planform area of 10–30 percent of a blade planform area. The root portion may have a radial span of 15–30 percent of a blade radial span.

In another aspect, the invention is directed to a fin-stabilized discarding sabot with tracer projectile where at least two tail fin blades are formed having a portion extending by an angle relative to a longitudinal direction. The angle is effective to impart the projectile with a steady state spin rate (SSSR) within upper and lower limits as a function of caliber (C) respectively defined by the equations:

$$(SSSR-340)/(C-25)=(99-SSSR)/(120-C); \text{ and}$$

$$(SSSR-420)/(C-25)=(122-SSSR)/(120-C)$$

In various implementations of the invention, there may be exactly four such blades, the angle may be between 4.3 and 5.2 degrees, and the projectile may have a caliber between 13 and 30 mm.

In another aspect, the invention is directed to a fin-stabilized discarding sabot with tracer projectile for firing from a barreled weapon of nominal 25 mm caliber wherein the projectile achieves a steady state spin rate (SSSR) of at least 340 rps. In various implementations of the invention, the SSSR may be between 340 and 420 rps, the muzzle velocity may be between 1300 and 1500 m/s and the projectile may have a muzzle spin rate higher than the SSSR but lower than an intervening peak spin rate.

In another aspect, the invention is directed to reengineering the configuration of a fin-stabilized discarding sabot with tracer projectile from an initial condition to an improved condition wherein in the improved condition the projectile has an increased steady state spin rate and improved tracer visibility.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
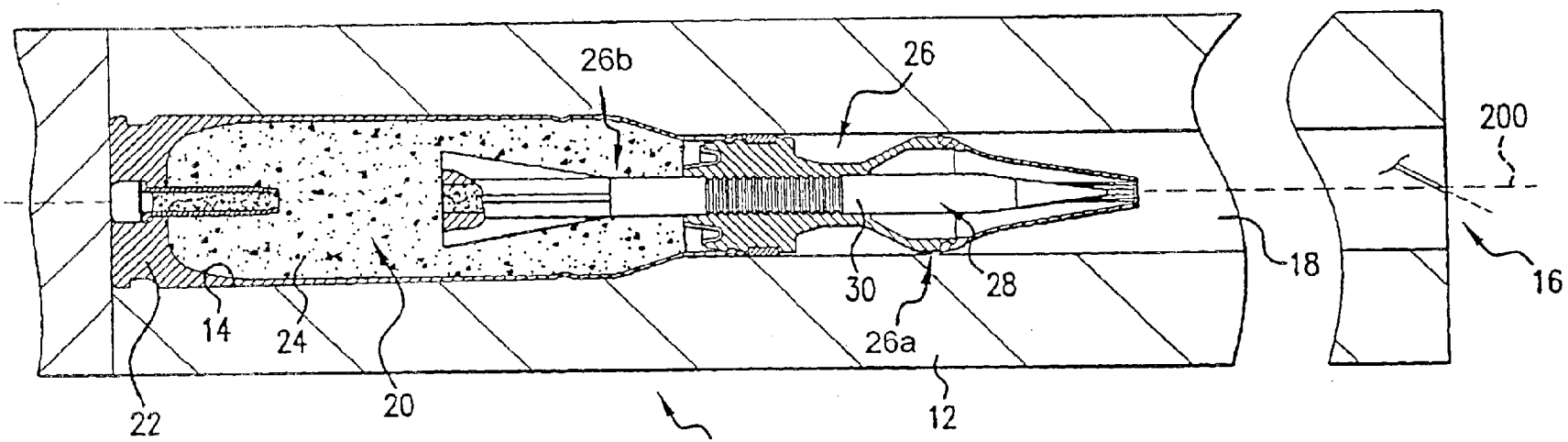
FIG. 1 is a partial cut away longitudinal cross-sectional view of an ammunition round including a saboted projectile according to principles of the invention chambered in a weapon.

FIG. 1 shows a weapon 10 having a barrel 12 extending from a chamber 14 at the aft end of the barrel 12 to a muzzle 16 formed by a fore end of the barrel. The barrel 12 extends along a central longitudinal axis 200 and has a rifled bore or inner surface 18. Typically, the rifling has a right hand gain twist as is common for weapons of U.S. manufacture although the invention is amenable to a left hand twist, to constant twist and to smoothbore barrels. The illustrated barrel is shown in highly schematic fashion and is not intended to be a precise depiction of the barrel of any particular weapon.

Figure 2:
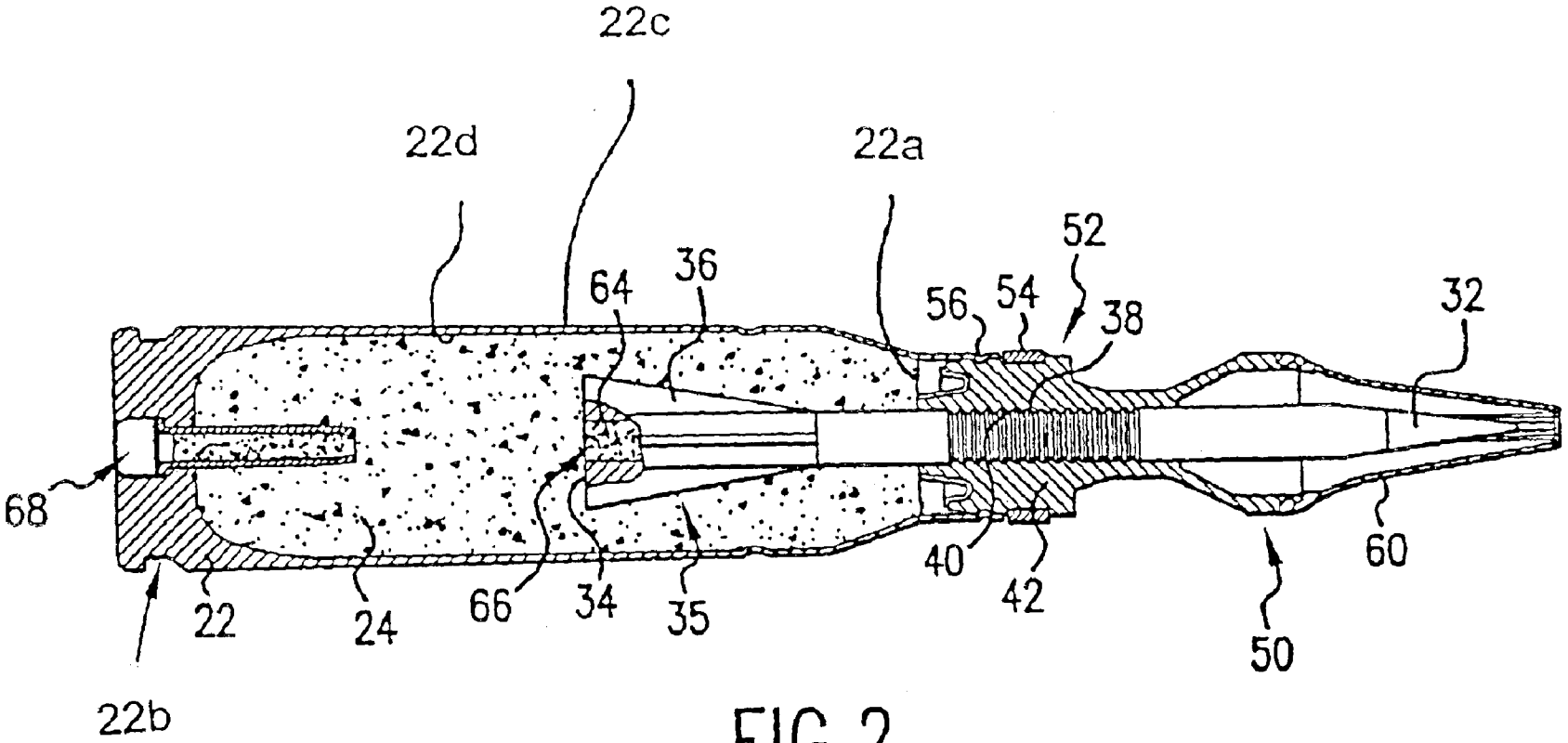
FIG. 2 is a longitudinal cross-sectional view of the round of FIG. 1.

An ammunition round 20 is provided having a case 22 accommodated within the chamber 14. The case 22 comprises a sidewall 22*c* that extends from a base 22*b* to a mouth 22*a* bounding an interior 22*d* that is substantially filled with a propellant 24 such as Wimmis E I. A saboted projectile 26 is accommodated within the mouth of the case 22, an aft portion 26*b* extending into the case 22 and a fore portion extending into the barrel 12. The projectile, shown as a long rod penetrator 28, includes a body 30 formed primarily of a high-density metal such as tungsten and/or depleted uranium. The body 30 (FIG. 2) extends from a nose 32 (formed as an aerodynamic ballistic tip) to a tail 34. The body includes the core of a fin unit 35 proximate the tail. The fin unit 35 bears a plurality of (for example, four) blades 36 extending generally radially outward. Centrally along the body 30, the penetrator bears interlocking features 38 engageable with mating interlocking features 40 of the sabot 42. The features 38 and 40 may be formed as screw-like threads or as annular thread-like grooves/protrusions engaged with each other so as to be effective to prevent relative longitudinal movement of the penetrator and sabot.

The sabot 42 is formed in a series of segments or petals. The petals are identical to each other which facilitates a balanced sabot and smooth discard of the sabot. The petals are separated from each other along planar interfaces at equal angles about the axis 200. The assembled sabot fully encircles a portion of the penetrator body. The sabot includes fore and aft protuberances 50 and 52 dimensioned to cooperate with the bore 18 so as to maintain the projectile substantially centered along the axis 200. In the exemplary embodiment, the petals, and thus the sabot body, are primarily formed of aluminum. The aft protuberance 52 carries a slip obturator 54 in an annular outward-directed channel and includes a second annular outward-directed channel 56 at which the sabot is crimped into the case neck. The fore protuberance 50 is formed as a scoop and carries a hood or shroud 60. A tracer charge 64 (e.g., of U.S. Pat. No. 5,472,536 of Doris et al., the disclosure of which is incorporated by reference in its entirety herein) is carried within a cylindrical pocket 66 in an aft section of the projectile. A primer 68 in the head of the case 22 is provided to ignite the propellant 24 via an intervening flash tube and flash charge. The ignition of the propellant 24 propels the projectile down the barrel and ignites the tracer charge 64.

Figure 3:
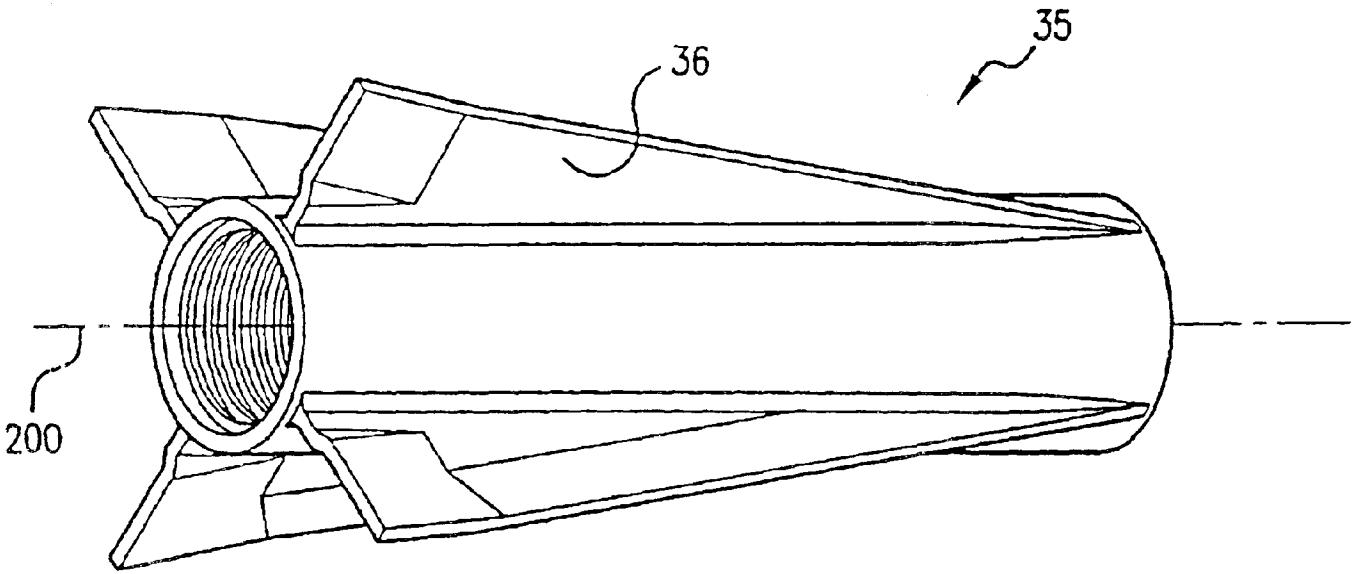
FIG. 3 is a perspective of a tail portion of the projectile of FIGS. 1 and 2.
Figure 7:
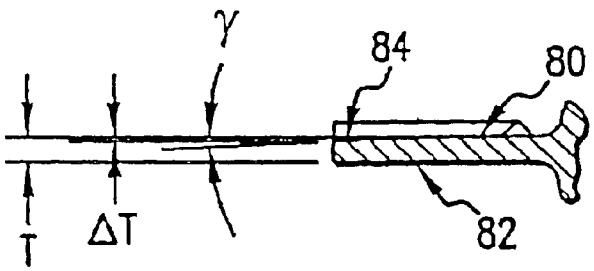
FIG. 7 is a cross-sectional view of the projectile of FIG. 4, taken along line 7—7.
Figure 5:
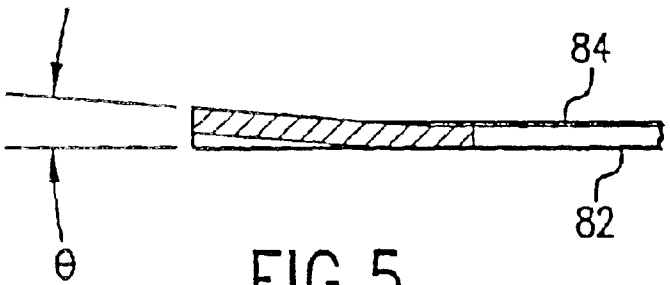
FIG. 5 is a longitudinal cross-sectional view of a fin of the projectile of FIG. 4 taken along line 5—5.
Figure 4:
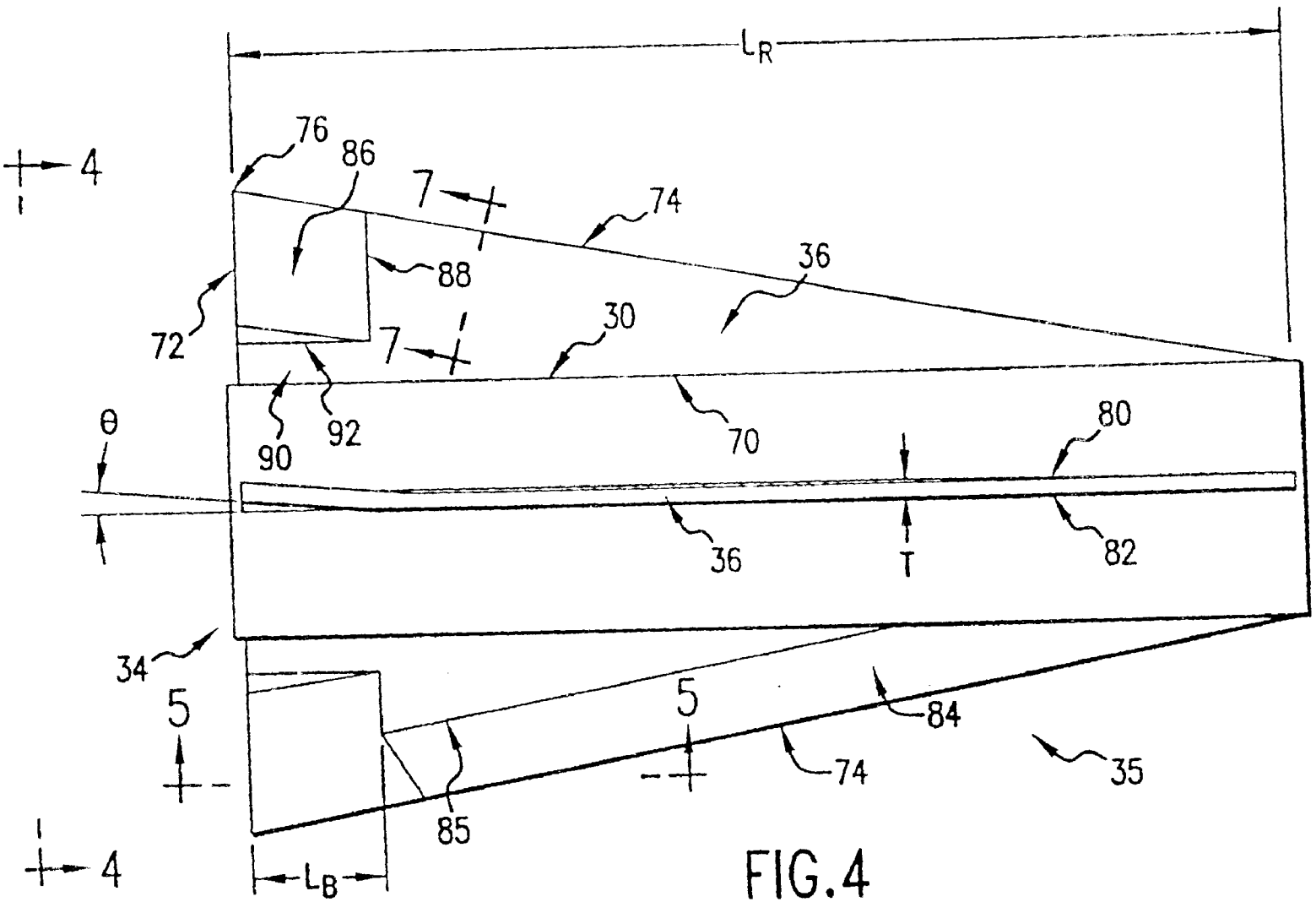
FIG. 4 is a side view of a tail portion of the projectile of FIGS. 1 and 2.

FIGS. 3 and 4 show further details of the exemplary blades 36. These are of a nominal delta configuration, which, with the projectile body 30 being of nominal cylindrical configuration in the tail area, are approximately right triangles in plan, having a long side 70 (FIG. 4) as a root, a short side 72 as a trailing edge, and a hypotenuse 74 as a leading edge with a blade tip 76 at the junction of the leading and trailing edges. Each blade 36 includes first and second surfaces 80 and 82, respectively facing counterclockwise and clockwise when viewed from the tail. Extending back from the leading edge 74, a forward portion 84 of the surface 80, meets a remainder of the surface 80 along a junction 85. FIG. 7 shows the surface portion 84 angled by an angle $\gamma$ relative to the surface 82 when viewed transverse to the blade leading edge. The exemplary angle $\gamma$ is about 2.5 degrees (more broadly between 1.5 and 3.5 degrees and more preferably 2°45'±30').

Figure 6:
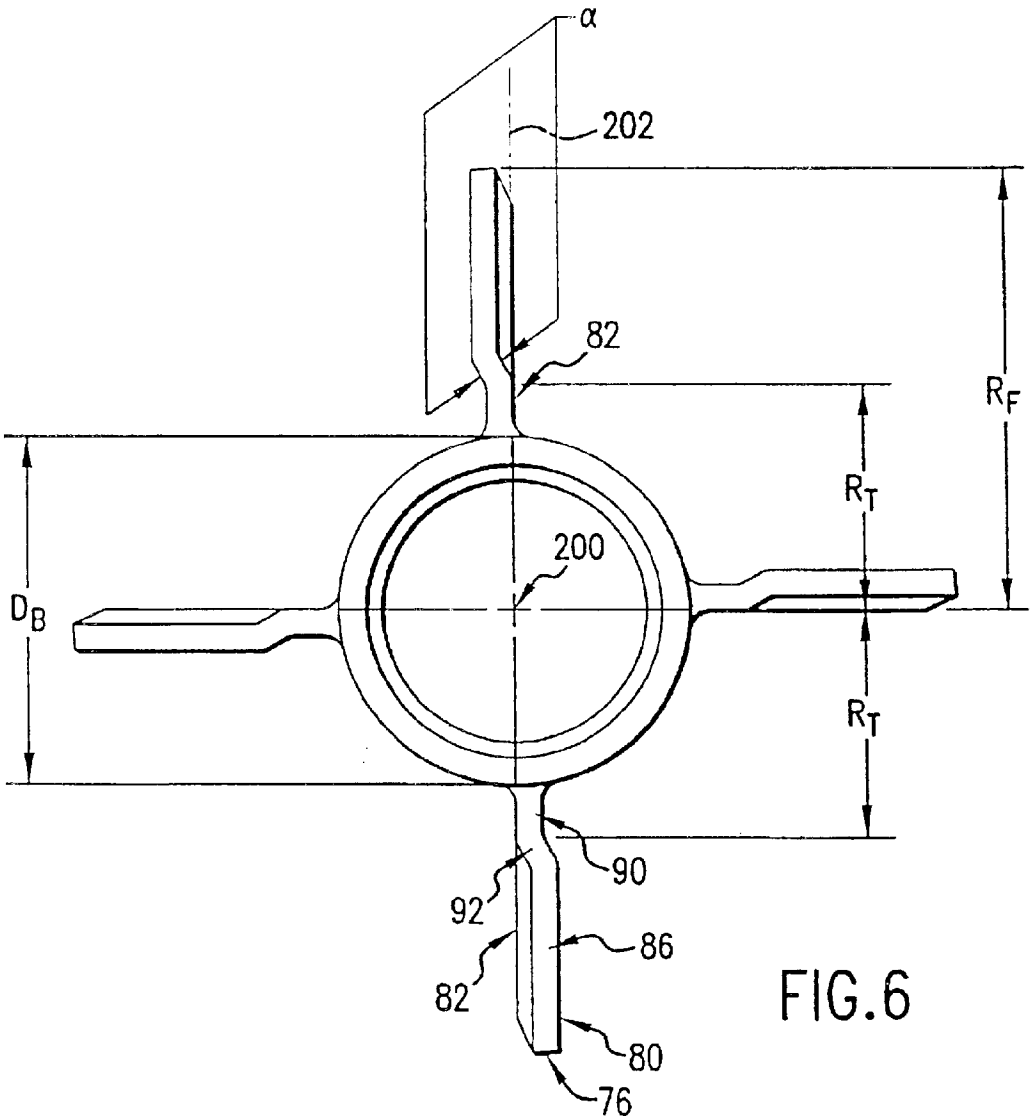
FIG. 6 is a rear view of the projectile of FIG. 4, taken along line 6—6.

FIG. 6 shows the exemplary positioning of the blades 36 so that their surfaces 82 extend approximately radially (i.e., they lie in an associated radial plane 202 extending from the axis 200). The surfaces 80 are, accordingly, offset from that radial plane. A portion 86 proximate the fin tip 76 is deflected relative to the remainder of the fin. The portion 86 is deflected along an approximately radial transition line 88 (FIG. 4) by an angle $\theta$. The transition line 88 is very close to radial along the surface 82 but along the surface 80 is radial until reaching the angled surface 84 whereupon it extends closer to normal to the fin leading edge. As discussed in further detail below, the deflected portion 86 advantageously only extends for a portion of the distance from the tip 76 to the body 30. An undeflected root portion 90 extends from the body 30 to a short transition region 92 between the root portion and the deflected portion 86. In the exemplary embodiment the root extends longitudinally. Small, relatively insubstantial deviations, (e.g., under two degrees and, preferably well under one degree) should also be possible.

An exemplary method of manufacture for the fin unit 35 involves injection molding of a stainless steel powder-filled polymer followed by sintering to remove the polymer and provide the fin unit with a straight bladed near net shape configuration. Subsequent machining and coining operations provide the internal features and the deflected blade configuration, respectively. An alternative means of producing this fin is to injection mold this part as a net shaped geometry by adjusting the inserts used in the mold to form the detailed profiles of the fin blades.

In the exemplary embodiment of an enhanced M919 projectile, the projectile body has a diameter $D_B$ at blade roots of approximately 0.340 inch. The radius $R_F$ at the blade tip 76 is 0.4265−0.01 inch. An exemplary radius $R_T$ at central portion of the transition region 92 is 0.2425+/−0.013 inch. Thus a root radial span is approximately $R_T$−0.5 $D_B$ while a deflected portion radial span is approximately $R_F$−$R_T$. An exemplary longitudinal span $L_B$ (FIG. 4) of the fin bent portion from the line 88 to the trailing edge is 0.1720+0.015−0.030 inch. This results in a deflected portion planform area of about 0.204 inch$^2$ or 20% of the fin planform area. As viewed from the rear, the transition region 92 is angled at an angle $\alpha$ of approximately 30 degrees. A blade root length $L_R$ is 1.401 inches and the blade thickness T is 0.023−0.005 inch. The presence of the angled surface 84 reduces fin thickness at the leading edge by an amount $\Delta T$ of less than 0.01 inch (or preferably 0.0045+0.0035 inch). An overall projectile length is about 5.69 inches and an overall mass about 98 g. Such a mass may be achieved via the incorporation of depleted uranium (DU) in the projectile body. If a material of lesser density (e.g., tungsten) is utilized, minor changes in blade configuration may be made to accommodate either for increased projectile body volume, decreased projectile body mass or a combination thereof.

When the basic flat plate prior art configuration is provided with the deflected portions 86, the torque applied by interaction of the blades with the air is altered. With the exemplary deflection of the blade trailing edge counterclockwise when viewed from the tail, the result is to increase the torque exerted on the projectile about the axis 200 and, thereby, increase the steady state spin rate of the projectile about that axis.

With the exemplary M919 basic flat plate fin blade design, the SSSR was somewhat less than 100 rps. It had been separately observed that an increase in SSSR can ameliorate occasional erratic flight conditions associated with the projectile's spin rate passing through certain resonance frequencies. This is the phenomenon when a sub-projectile's rotational and yawing motions couple, creating a corkscrew motion in the flight projectile about its center of gravity. It was noted that the prior exemplary M919 did in fact exhibit such occasional erratic flight characteristics, degrading its overall lethality. An exemplary angle $\theta$ of approximately 2.5 degrees was able to increase the round's SSSR into the range of 100 to 125 rps, thereby extending the flight interval through which the spin rate remained above spin-yaw resonance. Such a projectile has observed spin rates of 435 and 335 rps at 15 and 195 meters downrange respectively. It was later learned that such a spin rate profile was observed not to improve tracer visibility to a preferred level.

It was subsequently observed that with increases in the projectile's SSSR, trace visibility was enhanced. This is believed to be associated with an increase in the radial dispersion of the combustion trail created by the burning tracer material located in the rear of the fin assembly. Trace visibility was determined by the observation of a trace signature by military personnel, seated in the turret of a BFV from which the round was fired. The tracer composition illuminates in both the visible and infrared spectra, allowing use of both daytime visible light and nighttime Forward Looking Infrared (FLIR) modes. Trace visibility is important to the gunner of a BFV as it provides him the ability to adjust aim on target at extended engagement ranges. All trace observations were made while looking through vehicle's integrated sight system (designated Integrated Sight Unit (ISU), national stock number 1240-01-216-6331). This optical system provides laser protection to the soldier, and was operated in both day-clear and FLIR modes. A successful visible trace was one that presented a visible signature to either soldier located in the turret from muzzle to target as one continuous lit image. The exemplary M919 rounds with basic flat plate fins were typically visible only during the last one-third of their trajectories, just as the sub-projectile approached its target. This made it difficult for a BFV gunner to locate and follow the tracer image under battlefield conditions. As trace visibility was gradually enhanced over time, the trace image of the M919 over the first one-third of the round's trajectory became more readily seen, and then the middle-third, completing the visibility of the round over its entire trajectory. As discussed in further detail below, the acquired trace visibility improvements required further changes to the M919 round other than just increasing its SSSR.

With increases in the exemplary angle θ, the corresponding SSSR of the rounds were increased, and visibility enhancements were observed. Modest visibility enhancements were observed at a corresponding SSSR of 200 rps, while significant visibility enhancements were observed with SSSR above 300 rps. The preferred SSSR value for the enhanced M919 projectile is believed to be between 340 and 420 rps. As in all types of APFSDS rounds, there is an upper boundary in SSSR. It has been observed that when the SSSR of the M919 was allowed to exceed 420 rps, the sub-projectile would randomly experience dynamic flight instabilities in an ever-increasing percentage of rounds as the SSSR was further increased. This degraded the overall lethality of the round (e.g., increased round-by-round dispersion, increased velocity decay, and higher down-range projectile yaw degrading penetration). With the exemplary blade geometry and an angle θ of 4.9 degrees, the enhanced M919 projectile had observed spin rates of 532, 606, and 380 rps at 15 m from the mizzle, 195 m from the mizzle, and one second of flight from the muzzle, respectively. This nominal spin history exhibited no adverse effects on the round's muzzle velocity, velocity decay, or lethality performances. Small changes about the fin's exemplary angle of 4.9 degrees, and corresponding SSSR (e.g., advantageously fewer than 5%, and preferably under 1%) should be tolerable.

In the foregoing example of an enhanced M919 projectile, it is seen how the spin rate of the enhanced sub-projectile might actually temporarily increase during the initial stages of flight after leaving the muzzle. It was however observed that after less than approximately one-half second, the spin rate of the sub-projectile would peak and then begin to decay. With the exemplary geometry of the enhanced M919 fin profile, it has been demonstrated that an angle θ of between 4.3 and 5.2 degrees would provide an SSSR in the preferred range of 340 and 420 rps.

It had also been observed that in addition to increasing the round's SSSR, it became necessary to reduce the amount of muzzle obscuration, cause the tracer to burn hotter, and optimize the air flow over the fin blades to achieve the trace visibility most desired by the soldier. Thus is became a technical challenge to implement all of the above changes in parallel such that there were no degradations in the round's safety and lethality performance characteristics. The soldier is typically unwilling to trade-off performance for improved tracer visibility.

Reduced muzzle obscurations were achieved with the introduction of Nitrochemie El propellant (Nitrochemie AG, Wimmis Germany) into full-rate production. This required an elaborate ballistic test to demonstrate that all of the M919 round's interior ballistic (e.g., pressure, velocity and action time) and barrel life requirements across the required temperature extremes would be maintained. This is a lower flame temperature propellant of equal energy that allowed it to replace the original Hercules blended propellant (Alliant Techsystems Inc., Hopins, Minn.) and grease-paste barrel erosion inhibitor. Use of this older ignition system created both an excessive amount of smoke and thermal obscuration (heat waves) as the projectile exited the gun tube. These effects tended to linger about the front of the vehicle, causing difficulties in seeing down range with the vehicle's sight system. Until these effects dissipated naturally, and/or were moved away from in front of the vehicle by preferable cross-wind conditions, it was difficult to see tracer images until the later portion of the round's trajectory. Thus reducing the amount of muzzle obscuration was an integral part of improving the trace visibility of the M919 during its first-third of its trajectory.

The provision of the root portion 90 being oriented more longitudinally than the deflected portion 86 is believed to have a major contribution to enhancing tracer visibility. Other aerodynamic features such as canting the entire fin blades at higher angles of attack, deflecting the entire trailing edge 72 of the fins, or using other means to induce increases in SSSR (e.g., airfoil sections and the like) were not as effective in increasing the visibility of the tracer as the exemplary fin geometry shown in FIGS. 3 and 6. In many instances, there were degradations in trace visibility. It was demonstrated that optimizing the airflow over the fin assembly was an integral part in attaining the level of trace visibility deemed necessary to the soldier. It became necessary not to disrupt the airflow closest to the body 30 of the fin, allowing it to mix with the increased dispersion of the fuel-rich combustion trail created by the burning tracer. It is therefore theorized that improved trace visibility is related to the ability to increase the size and burning characteristics of the tracer plume through higher SSSR and optimized airflow over the M919 fin. This approach improved the trace visibility of the M919 during its middle-third of its trajectory. Therefore it is believed important that the transition region 92 be located between approximately 20 and 40 percent of the radial span of the blade, and more particularly, approximately 35 percent in the exemplary delta-blade enhanced M919 fin configuration.

Observations in both day and FLIR (night) modes found the enhanced projectile to consistently and reliably provide continuous visibility along the entire path from muzzle to target at up to the maximum effective range of the projectile. This occurred in approximately 96 percent of shots. Under similar circumstances, unenhanced projectiles were invisible through the sighting system in more than 60 percent of shots, with most of the remainder involving visibility during limited portions of the path.

For projectiles of similar size (e.g., saboted projectiles of nominal caliber between 20 mm and 50 mm, inclusive) substantially the same performance enhancements would be expected to be achieved by substantially the same modifications. For projectiles of much different caliber, performance enhancements are believed attainable with appropriately scaled modifications. By way of example, for an exemplary 120 mm APFSDS-T projectile used with NATO smoothbore tank cannons, the SSSR is lower than that of the M919. For example, an SSSR in the vicinity of 90 rps is a relatively high value at a muzzle velocity of 1670 m/s. It is theorized that a steady state spin rate of between one quarter and one third that of the M919 projectile would be effective for the 120 mm projectile. An approximation may, therefore, be made of desired SSSR as a function of caliber given the observed 25 mm and theorized 120 mm examples. Using the upper and lower limits of 340 and 420 rps for the 25 mm embodiment and splitting the difference between one quarter and a third thereof for the 120 mm embodiment, linear functions for similarly desirable lower and upper limits as a function of caliber (C) may be approximately:

$$(SSSR-340)/(C-25)=(99-SSSR)/(120-C);\text{ and}$$

$$(SSSR-420)/(C-25)=(122-SSSR)/(120-C);$$

wherein SSSR is in rps and C is in mm. Other forms of scaling and approximation may be appropriate such as scaling based upon existing SSSR, fin span, projectile mass, and the like.

In high rate of fire applications typically characteristic of smaller caliber weapons, it may be desirable to intersperse tracered rounds with untracered rounds. For example, every $n^{th}$ (e.g., $2^{nd}$–$5^{th}$) round in a magazine or chain may be tracered. It may be desirable to similarly enhance the untracered rounds to maintain performance consistency with the enhanced tracered rounds fired in the same sequence.

One or more embodiments of the present invention have been described. Nevertheless, it will be understood that various modifications may be made without departing from the spirit and scope of the invention. For example, although illustrated with respect to a particular APFSDS-T projectile using a particular configuration of double ramp sabot, the principles of the invention may be applied to other fin-stabilized projectiles and to projectiles using a variety of sabots including pull-type sabots wherein the obturator is located in a relatively forward location (e.g., on a forward protuberance or flange). Accordingly, other embodiments are within the scope of the following claims.

What is claimed is:

1. A method of reengineering a configuration of fin-stabilized discarding sabot with tracer projectile for firing from a given barreled weapon of given caliber (C), from an initial configuration to an improved configuration, wherein:

when fired from said weapon with a first muzzle velocity of between 1300 and 1700 m/s the projectile achieves a steady state spin rate of less than 200 rps in said initial configuration, the method comprising:

reengineering of the configuration of the fin blades of said projectile so that when fired from said weapon with a second muzzle velocity within 5% of said first muzzle velocity, the projectile achieves a steady state spin rate (SSSR) within lower and upper limits respectively defined by the lines:

$$(SSSR-340)/(C-25)=(99-SSSR)/(120-C);\text{ and}$$

$$(SSSR-420)/(C-25)=(122-SSSR)/(120-C);$$

wherein SSSR is in rps and C is in mm.

2. The method of claim 1 wherein:

the reengineering provides an increase in SSSR from the initial configuration to the improved configuration of at least 10 percent.

3. The method of claim 1 wherein:

the reengineering provides a substantial increase in tracer visibility from the initial configuration to the improved configuration so that:

with at least 90 percent reliability the improved configuration provides infrared visibility from a firing weapon along a majority of a flight path from a muzzle of the weapon to a target at least one kilometer away under conditions where the initial configuration provides such visibility with less than 50 percent reliability.

4. The method of claim 1 wherein:

the reengineering provides a substantial increase in tracer visibility from the initial configuration to the improved configuration so that:

with at least 90 percent reliability the improved configuration provides infrared visibility from a firing weapon along at least 90 percent of a flight path from a muzzle of the weapon to a target at least one kilometer away whereas the initial configuration provides such visibility with less than 10 percent reliability.

5. The method of claim 1 wherein:

the reengineering provides a substantial increase in tracer visibility from the initial configuration to the improved configuration;

the reengineering comprises reconfiguring each of the fin blades to have single tip portion angularly deflected relative to a remainder of such fin; and steady state spin rate and an intervening peak spin rate higher than said muzzle spin rate.

6. The method of claim 1 wherein:

the reengineering comprises reconfiguring each of the fin blades to have single tip portion angularly deflected relative to a remainder of such blade; and the reengineering comprises similarly reconfiguring an untracered projectile to maintain similar flight characteristics to the improved configuration of said fin-stabilized discarding sabot with tracer projectile.

* * * * *